US012788124B2

(12) United States Patent
Yu

(10) Patent No.: US 12,788,124 B2
(45) Date of Patent: Nov. 10, 2026

(54) FORK FOR CARTRIDGE CORE, CARTRIDGE CORE, AND COSMETIC CONTAINER

(71) Applicant: SHYA HSIN PACKAGING INDUSTRY (CHINA) CO., LTD., Kunshan (CN)

(72) Inventor: Fuhai Yu, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 109 days.

(21) Appl. No.: 18/870,473

(22) PCT Filed: Jun. 29, 2023

(86) PCT No.: PCT/CN2023/103594
§ 371 (c)(1),
(2) Date: Nov. 29, 2024

(87) PCT Pub. No.: WO2024/139119
PCT Pub. Date: Jul. 4, 2024

(65) Prior Publication Data

US 2025/0338945 A1 Nov. 6, 2025

(30) Foreign Application Priority Data

Dec. 27, 2022 (CN) ..... 202223493290.7

(51) Int. Cl.
*A45D 40/06* (2006.01)
*A45D 40/00* (2006.01)

(52) U.S. Cl.
CPC ..... *A45D 40/06* (2013.01); *A45D 2040/0025* (2013.01)

(58) Field of Classification Search
CPC ..... A45D 40/06; A45D 2040/0025; A45D 40/00; A45D 40/04; A45D 40/02; A45D 40/12; A45D 40/205; A45D 2040/208
USPC ..... 401/55, 68, 74, 75, 77, 78
See application file for complete search history.

(56) References Cited

U.S. PATENT DOCUMENTS 5,096,318 A * 3/1992 Susini ..... A45D 40/06 401/78
5,324,126 A * 6/1994 Holloway ..... A45D 40/06 401/78
6,036,387 A * 3/2000 Gueret ..... A45D 40/06 401/78

(Continued)

FOREIGN PATENT DOCUMENTS

CN 204292453 U 4/2015
CN 206238698 U 6/2017

(Continued)

*Primary Examiner* — David J Walczak
(74) *Attorney, Agent, or Firm* — Bayramoglu Law Offices LLC

(57) ABSTRACT

A fork for a cartridge core, a cartridge core, and a cosmetic container includes a fork body, where a chute is formed in the fork body; a lower end of the fork body has a coupling portion; the fork body has an elastic piece between the chute and the coupling portion; the elastic piece extends outward along a radial direction of the fork body; the fork body is made of a plastic material; and a thickness of the elastic piece is ⅓ to ½ of a wall thickness of the fork body.

20 Claims, 7 Drawing Sheets

(56) References Cited

U.S. PATENT DOCUMENTS

| | | | | |
|---|---|---|---|---|
| 11,485,567 | B2 * | 11/2022 | Lin | B65D 83/76 |
| 2003/0031497 | A1 | 2/2003 | Ohba et al. | |
| 2007/0059088 | A1 * | 3/2007 | Chan | A45D 40/06<br>401/75 |

FOREIGN PATENT DOCUMENTS

| | | | |
|---|---|---|---|
| CN | 107232736 | A | 10/2017 |
| CN | 207613375 | U | 7/2018 |
| CN | 114539729 | A | 5/2022 |
| CN | 216675037 | U | 6/2022 |
| CN | 219125601 | U | 6/2023 |
| WO | 2021068561 | A1 | 4/2021 |
| WO | 2021139423 | A1 | 7/2021 |
| WO | 2021189509 | A1 | 9/2021 |

* cited by examiner

FORK FOR CARTRIDGE CORE, CARTRIDGE CORE, AND COSMETIC CONTAINER

CROSS-REFERENCE TO THE RELATED APPLICATIONS

This application is the national phase entry of International Application No. PCT/CN2023/103594, filed on Jun. 29, 2023, which is based upon and claims priority to Chinese Patent Application No. 202223493290.7, filed on Dec. 27, 2022, the entire contents of which are incorporated herein by reference.

TECHNICAL FIELD

The present application relates to the field of cosmetic packaging, and in particular to a fork for a cartridge core, a cartridge core, and a cosmetic container.

BACKGROUND

A cartridge core serves as a core component in cosmetic containers for lipstick, lip balm, lip gloss, etc. The cartridge core usually includes a fork, a cup, and a spiral. In order to make the product aesthetically pleasing, and because of limitations on the manufacturing process, some components in the cartridge core are made of a metal material, and some components are made of a plastic material. Since each component in the cartridge core is hard to disassemble, a cartridge core made of different materials cannot be recycled and causes a waste of resources.

SUMMARY

In order to overcome the above defects, the present application provides a fork for a cartridge core. The fork is made of the plastic material, such that the whole cartridge core is recycled conveniently. By providing the elastic piece on the fork, the present application ensures the smooth rotation of the cartridge core, and the desirable hand feel of the cartridge core in operation.

To solve the technical problems, the present application employs the following technical solutions:

The present application provides a fork for a cartridge core, including a fork body, where a chute is formed in the fork body; a lower end of the fork body is provided with a coupling portion; the fork body is provided with an elastic piece between the chute and the coupling portion; the elastic piece extends outward along a radial direction of the fork body; the fork body is made of a plastic material; and a thickness of the elastic piece is ⅓ to ½ of a wall thickness of the fork body.

Optionally, a thickness of a thickest portion of the elastic piece is ⅓ to ½ of an average wall thickness of the fork body.

Optionally, the average wall thickness of the fork body ranges from 0.4 mm to 1 mm, and the thickness of the thickest portion of the elastic piece ranges from 0.15 mm to 0.5 mm.

Optionally, the elastic piece is a sheet-like structure; the elastic piece includes a root fixedly connected to the fork body, and a free end away from the fork body; a width of the elastic piece is gradually reduced from the root to the free end; and the thickness of the elastic piece is gradually reduced from the root to the free end.

Optionally, the free end of the elastic piece has a thickness of D1, and the root of the elastic piece has a thickness of D2, the D1 ranging from 0.06 mm to 0.12 mm, and the D2 ranging from 0.12 mm to 0.18 mm; and a length from the root of the elastic piece to the free end of the elastic piece is L, the L ranging from 0.8 mm to 1.5 mm.

Optionally, the elastic piece includes an upper surface and a lower surface that are opposite to each other; the upper surface and the lower surface are gradually close from the root of the elastic piece to the free end of the elastic piece; both the upper surface and the lower surface are obliquely provided on the fork body; or the upper surface is obliquely provided on the fork body, and the lower surface is vertically provided on the fork body; or the upper surface is vertically provided on the fork body, and the lower surface is obliquely provided on the fork body.

Optionally, there is an included angle $\alpha$ between the lower surface and the fork body, $\alpha>90°$; a retainer ring is provided on the fork body between the elastic piece and the coupling portion; and a distance between the retainer ring and the upper surface of the elastic piece is H, the H ranging from 1.5 mm to 2.5 mm.

Optionally, at least a pair of elastic pieces are provided on the fork body; and two elastic pieces in the pair of elastic pieces are arranged symmetrically relative to an axis of the fork body.

The present application further provides a cartridge core, including the fork, a spiral, and a cup, where a feeding thread is provided on an inner sidewall of the spiral; a bump extending outward along a radial direction is provided on the cup; the spiral is rotatably sleeved on the fork; the cup is provided in the fork; the bump is stretched out of the chute; the bump cooperates with the feeding thread in the spiral; and the spiral and the cup are made of a plastic material.

The present application further provides a cosmetic container, including the cartridge core, an upper lid, and a bottom lid, where the bottom lid is sleeved on the cartridge core; the bottom lid and the fork are circumferentially fixedly together; and the upper lid is detachably provided on the bottom lid.

The present application has the following beneficial effects:

1) According to the present application, the fork includes a fork body. A chute is formed in the fork body. An elastic piece is provided on the fork body. The elastic piece extends outward along a radial direction of the fork body. The fork body is made of a plastic material. Optionally, the fork is made of polypropylene (PP) plastic. Other components of the cartridge core are also made of the plastic material. Therefore, the cartridge core made of the plastic material entirely can be recycled, thereby reducing the waste of resources.

2) According to the present application, the elastic piece is provided on the fork body, and the thickness of the elastic piece is ⅓ to ½ of the wall thickness of the fork body. In assembly, the elastic piece abuts against the spiral of the cartridge core. The elastic piece has elasticity and generates an elastic force after contacting the spiral, such that the cartridge core has a smoother hand feel in rotation, thereby omitting the originally added lubricant for environmental protection. In order to solve the problem that the fork made of the PP material and applied to the existing cartridge core has large resistance and hardly achieves normal rotation, the present application optimizes the thickness of the elastic piece. By defining the thickness of the elastic piece within a range from ⅓ to ½ of the wall thickness of the fork body, there is appropriate resistance between the fork and the spiral in rotation. This ensures the smooth rotation of the cartridge core, and the desirable hand feel of the cartridge core in operation.

In the figures: 10—fork body, 11—elastic piece, 12—retainer ring, 13—coupling portion, 14—chute, 15—upper surface, 16—lower surface, 20—spiral, 30—cup, 31—bump, 40—upper lid, and 50—bottom lid.

DETAILED DESCRIPTION OF THE EMBODIMENTS

The technical solutions in the embodiments of the present application are clearly and completely described below with reference to the embodiments of the present application. Apparently, the described embodiments are merely some rather than all of the embodiments of the present application. All other embodiments obtained by a person of ordinary skill in the art based on the embodiments of the present application without creative efforts shall fall within the protection scope of the present application.

It should be noted that the terms "first", "second", and so on in the description and claims of this application and in the above accompanying drawings are intended to distinguish similar objects but do not necessarily indicate a specific order or sequence. It should be understood that the data used in such a way may be exchanged under proper conditions to make it possible to implement the described implementations of this application in sequences except those illustrated or described herein. Moreover, the terms "include", "contain", and any other variants mean to cover the non-exclusive inclusion, for example, a process, method, system, product, or device that includes a list of steps or units is not necessarily limited to those steps or units which are clearly listed, but may include other steps or units which are not expressly listed or inherent to such a process, method, system, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Figure 1:
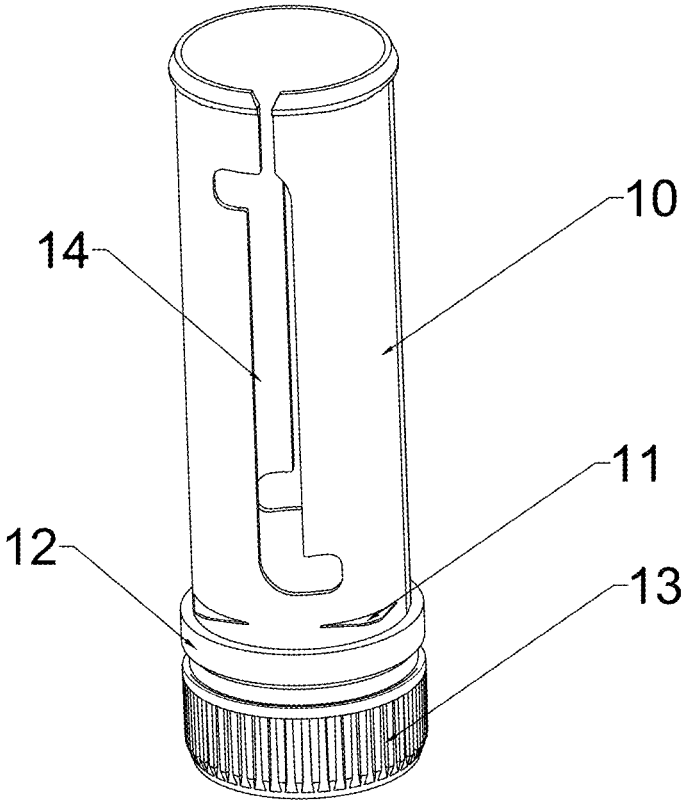
FIG. 1 is a schematic structural view of a fork according to the present application.
Figure 2:
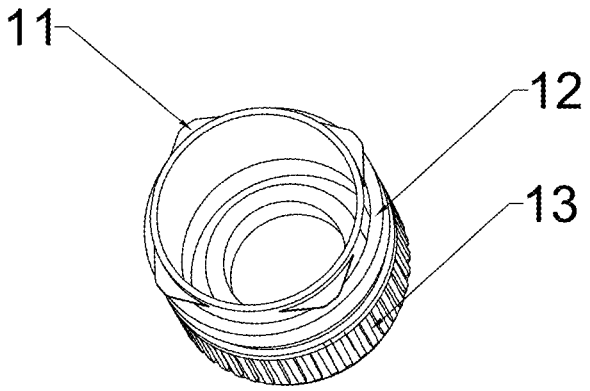
FIG. 2 is a partially schematic structural view of a fork according to the present application.
Figure 3:
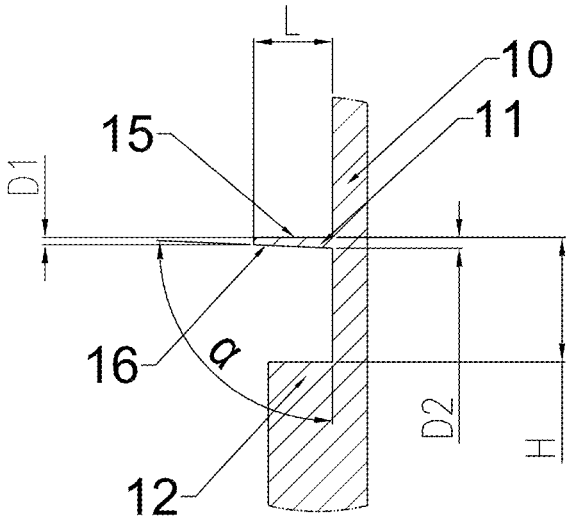
FIG. 3 is a partially sectional view of a fork according to the present application.

Embodiment: As shown in FIG. 1 to FIG. 3, a fork for a cartridge core includes fork body 10. Chute 14 is formed in the fork body 10. A lower end of the fork body 10 is provided with coupling portion 13. The fork body 10 is provided with elastic piece 11 between the chute 14 and the coupling portion 13. The elastic piece 11 extends outward along a radial direction of the fork body 10. The fork body 10 is made of a plastic material. A thickness of the elastic piece 11 is ⅓ to ½ of a wall thickness of the fork body 10. According to the present application, the fork body 10 is made of the plastic material. The plastic material includes, but is not limited to, polyethylene terephthalate (PET) plastic, polybutylene terephthalate (PBT) plastic, PP plastic, acrylonitrile butadiene styrene (ABS) plastic, polyoxymethylene (POM) plastic, etc. Optionally, the fork is made of the PP plastic. Other components in the cartridge core are also made of the plastic material. Therefore, the cartridge core made of the plastic material entirely can be recycled, thereby reducing the waste of resources. According to the present application, the elastic piece is provided on the fork body. In assembly, the elastic piece 11 abuts against the spiral of the cartridge core. The elastic piece has elasticity and generates an elastic force after contacting the spiral, such that the cartridge core has a smoother hand feel in rotation, thereby omitting the originally added lubricant for environmental protection. In order to solve the problem that the fork made of the PP material and applied to the existing cartridge core has large resistance and hardly achieves normal rotation, the present application optimizes the thickness of the elastic piece. Through repeated experimental verification, by defining the thickness of the elastic piece 11 within a range from ⅓ to ½ of the wall thickness of the fork body 10, there is appropriate resistance between the fork and the spiral in rotation. This ensures the smooth rotation of the cartridge core, and the desirable hand feel of the cartridge core in operation.

The thickness of the elastic piece 11 may be designed uniformly, and may also not be designed uniformly. When the thickness of the elastic piece 11 is not designed uniformly, a thickness of a thickest portion of the elastic piece 11 is ⅓ to ½ of the wall thickness of the fork body 10. Likewise, the wall thickness of the fork body 10 may be designed uniformly, and may also not be designed uniformly. When the wall thickness of the fork body is not designed uniformly, the thickness of the thickest portion of the elastic piece 11 is ⅓ to ½ of an average wall thickness of the fork body 10. Optionally, the fork body 10 has a uniform wall thickness.

Optionally, the average wall thickness of the fork body ranges from 0.4 mm to 1 mm. The thickness of the thickest portion of the elastic piece ranges from 0.15 mm to 0.5 mm. In a specific embodiment, the wall thickness of the fork body is 0.48 mm. The thickness of the elastic piece ranges from 0.16 mm to 0.24 mm.

As shown in FIG. 2, the elastic piece 11 is a sheet-like structure. The elastic piece 11 includes a root fixedly connected to the fork body 10, and a free end away from the fork body 10. A width of the elastic piece 11 is gradually reduced from the root to the free end. The thickness of the elastic piece 11 is gradually reduced from the root to the free end. The elastic piece 11 is a sheet extending outward along the radial direction of the fork body. The elastic piece has the wide root and the narrow free end, namely the whole elastic piece is a trapezoidal structure. The elastic piece 11 has the wide root, namely the junction between the elastic piece and the fork body has a large area, such that the bonding strength between the elastic piece and the fork body is improved. The elastic piece 11 has the narrow free end, such that the contact area between the free end of the elastic piece and the spiral is reduced, the contact resistance between the free end of the elastic piece and the spiral is reduced, and the elasticity of the elastic piece is increased. By reducing the thickness of the elastic piece 11 gradually from the root to the free end, the bonding strength between the elastic piece and the fork body is further improved, the contact elasticity between the elastic piece and the spiral is improved, and the resistance between the elastic piece and the spiral is reduced.

As shown in FIG. 3, the free end of the elastic piece 11 has a thickness of D1. The root of the elastic piece 11 has a thickness of D2. The D1 ranges from 0.06 mm to 0.12 mm. The D2 ranges from 0.12 mm to 0.18 mm. A length from the root of the elastic piece 11 to the free end of the elastic piece 11 is L. The L ranges from 0.8 mm to 1.5 mm. In a specific embodiment, the D1 is 0.1 mm, the D2 is 0.15 mm, and the L is 1.08 mm.

As shown in FIG. 3, the elastic piece 11 includes upper surface 15 and lower surface 16 that are opposite to each other. The upper surface 15 and the lower surface 16 are gradually close from the root of the elastic piece 11 to the free end of the elastic piece, such that the thickness of the elastic piece 11 is gradually reduced from the root to the free end. In an implementation, both the upper surface 15 and the lower surface 16 are obliquely provided on the fork body 10. In another implementation, the upper surface 15 is obliquely provided on the fork body 10, and the lower surface 16 is vertically provided on the fork body 10. In another implementation, as shown in FIG. 3, the upper surface 15 is vertically provided on the fork body 10, and the lower surface 16 is obliquely provided on the fork body 10.

As shown in FIG. 3, there is an included angle $\alpha$ between the lower surface 16 and the fork body 10, $\alpha>90°$. The fork body 10 between the elastic piece 11 and the coupling portion 13 is provided with retainer ring 12. A distance between the retainer ring 12 and the upper surface of the elastic piece 11 is H. The H ranges from 1.5 mm to 2.5 mm. Optionally, $\alpha<100°$. In a specific embodiment, the a is 92.5°, and the H is 1.7 mm.

As shown in FIG. 2, a pair of elastic pieces 11 are at least provided on the fork body 10. Two elastic pieces in the pair of elastic pieces 11 are arranged symmetrically relative to an axis of the fork body 10. In the embodiment, there are two pairs of elastic pieces 11. In each pair, two elastic pieces are arranged symmetrically along the axis of the fork body 10. This design facilitates demolding, and reduces the production difficulty. Certainly, one or three pairs of elastic pieces 11 may also be provided on the fork body 10 according to an actual condition.

Figure 4:
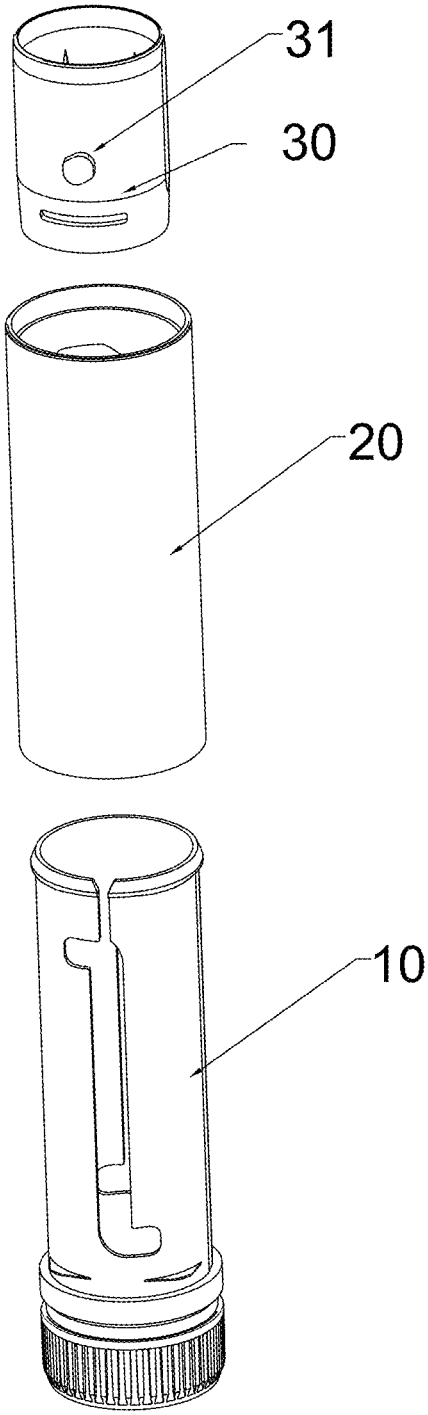
FIG. 4 is an exploded view of a cartridge core according to the present application.
Figure 5:
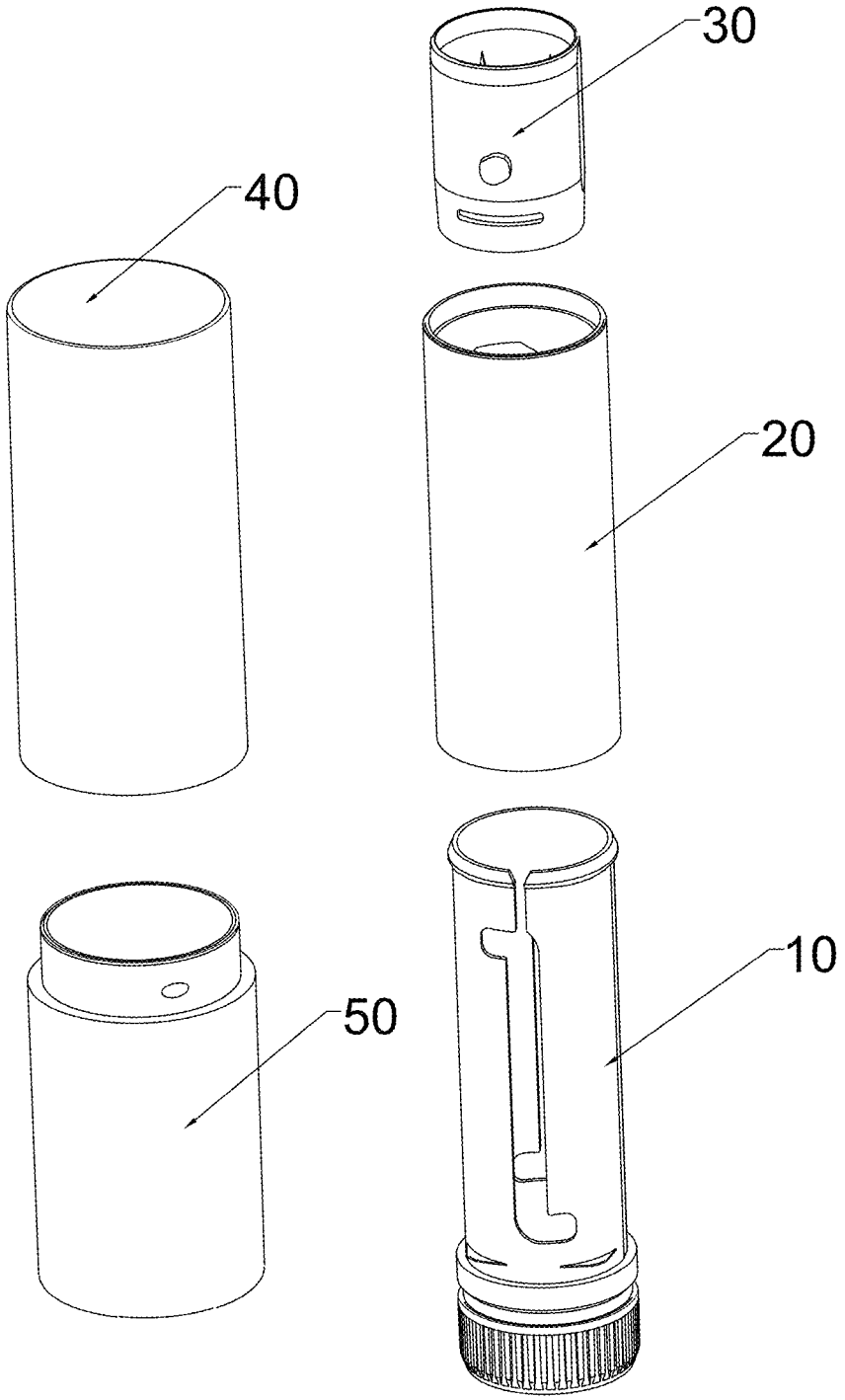
FIG. 5 is an exploded view of a cosmetic container according to the present application.
Figure 6:
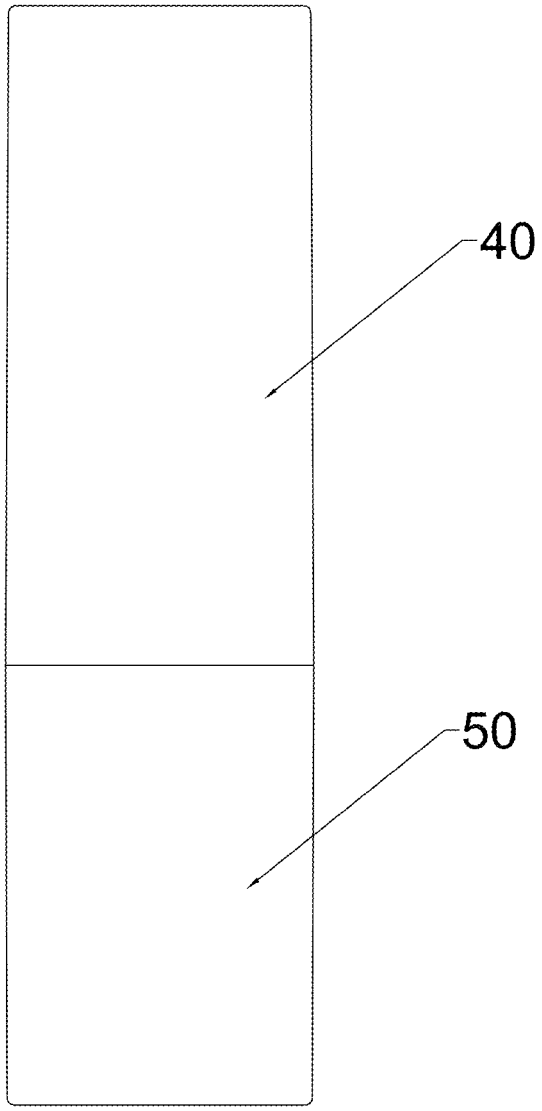
FIG. 6 is a schematic structural view of a cosmetic container according to the present application.
Figure 7:
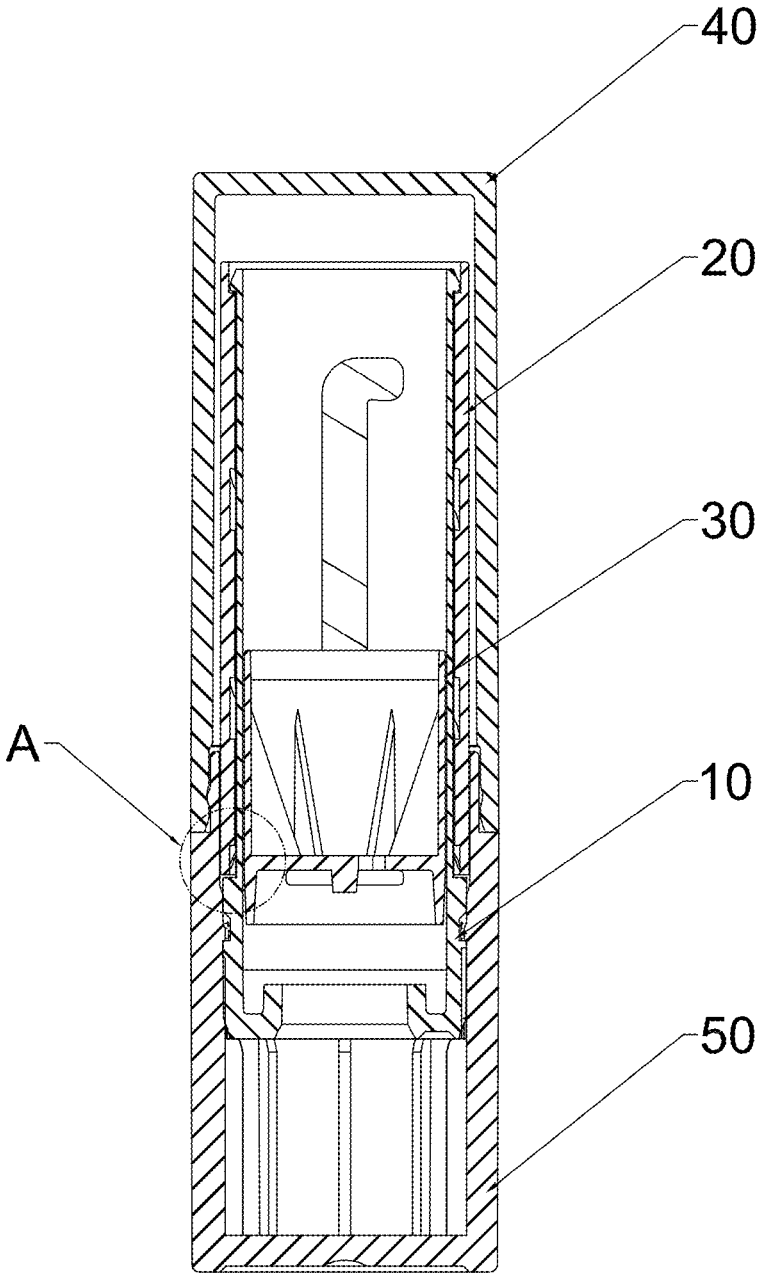
FIG. 7 is a sectional view of a cosmetic container according to the present application.
Figure 8:
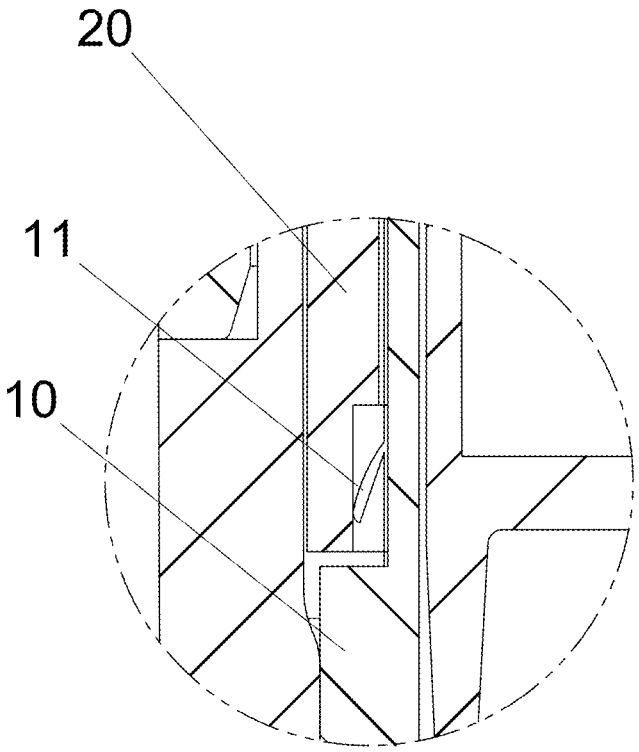
FIG. 8 is an enlarged view of A shown in FIG. 7.

As shown in FIG. 4, a cartridge core includes the fork, spiral 20, and cup 30. A feeding thread is provided on an inner sidewall of the spiral 20. Bump 31 extending outward along a radial direction is provided on the cup 30. The spiral 20 is rotatably sleeved on the fork. The cup 30 is provided in the fork. The bump 31 is stretched out of the chute 14. The bump 31 cooperates with the feeding thread in the spiral 20. The spiral 20 and the cup 30 are made of a plastic material. The cup 30 is configured to store a cosmetic material such as lipstick, lip balm, and lip gloss. The spiral 20 is sleeved on the fork body 10 in a circumferentially movable and axially unmovable manner. Therefore, when the fork body 10 rotates, the cup 30 slides up and down along the chute 14 of the fork body 10 under an action of the feeding thread of the spiral 20, such that the cosmetic material is stretched out of the cartridge core or retracted into the cartridge core.

As shown in FIG. 5 to FIG. 8, a cosmetic container includes the cartridge core, upper lid 40, and bottom lid 50. The bottom lid 50 is sleeved on the cartridge core. The bottom lid 50 and the fork are circumferentially fixedly together. The upper lid 40 is detachably provided on the bottom lid 50. The cosmetic container includes the cartridge core, the upper lid 40, and the bottom lid 50. The cartridge core is provided in the bottom lid 50. The fork and the bottom lid 50 are circumferentially fixed. That is, when the bottom lid 50 is rotated, the fork can rotate synchronously with the bottom lid 50. Optionally, the fork is detachably clamped on the bottom lid 50, so as to replace or recycle the cartridge core conveniently. The upper lid 40 is sleeved on the cartridge core, and the upper lid 40 is fixed with the bottom lid 50 through a fastener or a thread. When the cosmetic container is used, the upper lid 40 is taken down. The bottom lid 50 is rotated, such that the bottom lid 50 drives the fork body 10 to rotate. Under an action of the feeding screw of the spiral 20, the fork body 10 drives the cup 30 to slide up along the chute 14, such that the cosmetic material on the cup 30 is stretched out of the cartridge core for makeup of the user. Upon completion of the makeup, the bottom lid 50 is rotated reversely, such that the cosmetic material is retracted into the cartridge core. The upper lid 40 covers the bottom lid.

It should be noted that those of ordinary skill in the art can further make variations and improvements without departing from the conception of the present application. These variations and improvements all fall within the protection scope of the present application. Therefore, the protection scope of the present application shall be subject to the appended claims.

What is claimed is:

1. A fork for a cartridge core, comprising a fork body, wherein a chute—formed in the fork body; a lower end of the fork body is provided with a coupling portion; the fork body is provided with an elastic piece between the chute and the coupling portion; the elastic piece extends outward along a radial direction of the fork body; the fork body is made of a plastic material; and a thickness of the elastic piece is ⅓ to ½ of a wall thickness of the fork body.

2. The fork for the cartridge core according to claim 1, wherein a thickness of a thickest portion of the elastic piece is ⅓ to ½ of an average wall thickness of the fork body.

3. The fork for the cartridge core according to claim 2, wherein the average wall thickness of the fork body ranges from 0.4 mm to 1 mm, and the thickness of the thickest portion of the elastic piece ranges from 0.15 mm to 0.5 mm.

4. The fork for the cartridge core according to claim 1, wherein the elastic piece is a sheet-like structure; the elastic piece comprises a root fixedly connected to the fork body, and a free end away from the fork body; a width of the elastic piece is gradually reduced from the root to the free end; and the thickness of the elastic piece is gradually reduced from the root to the free end.

5. The fork for the cartridge core according to claim 4, wherein the free end of the elastic piece has a thickness of D1, and the root of the elastic piece has a thickness of D2, the D1 ranging from 0.06 mm to 0.12 mm, and the D2 ranging from 0.12 mm to 0.18 mm; and a length from the root of the elastic piece to the free end of the elastic piece is L, the L ranging from 0.8 mm to 1.5 mm.

6. The fork for the cartridge core according to claim 4, wherein the elastic piece comprises an upper surface and a lower surface, and the upper surface and the lower surface are opposite to each other; the upper surface and the lower surface are gradually adjacent—from the root of the elastic piece to the free end of the elastic piece; both the upper surface and the lower surface are obliquely provided on the fork body; or the upper surface is obliquely provided on the fork body, and the lower surface is vertically provided on the fork body; or the upper surface is vertically provided on the fork body, and the lower surface is obliquely provided on the fork body.

7. The fork for the cartridge core according to claim 6, wherein there is an included angle $\alpha$ between the lower surface and the fork body, $\alpha>90°$; a retainer ring is provided on the fork body between the elastic piece and the coupling portion; and a distance between the retainer ring and the upper surface of the elastic piece is H, the H ranging from 1.5 mm to 2.5 mm.

8. The fork for the cartridge core according to claim 1, wherein at least a pair of elastic pieces are provided on the fork body; and two elastic pieces in the pair of elastic pieces are arranged symmetrically relative to an axis of the fork body.

9. A cartridge core, comprising the fork according to claim 1, a spiral, and a cup, wherein a feeding thread is provided on an inner sidewall of the spiral; a bump extending outward along a radial direction is provided on the cup; the spiral is rotatably sleeved on the fork; the cup is provided in the fork; the bump is stretched out of the chute; the bump cooperates with the feeding thread in the spiral; and the spiral and the cup are made of a plastic material.

10. The cartridge core according to claim 9, wherein in the fork, at least a pair of elastic pieces are provided on the fork body; and two elastic pieces in the pair of elastic pieces are arranged symmetrically relative to an axis of the fork body.

11. A cosmetic container, comprising the cartridge core according to claim 9, an upper lid, and a bottom lid, wherein the bottom lid is sleeved on the cartridge core; the bottom lid and the fork are circumferentially fixedly together; and the upper lid is detachably provided on the bottom lid.

12. The cosmetic container according to claim 11, wherein in the cartridge core, a thickness of a thickest portion of the elastic piece is ⅓ to ½ of an average wall thickness of the fork body.

13. The cosmetic container according to claim 12, wherein in the cartridge core, the average wall thickness of the fork body ranges from 0.4 mm to 1 mm, and the thickness of the thickest portion of the elastic piece ranges from 0.15 mm to 0.5 mm.

14. The cosmetic container according to claim 11, wherein in the cartridge core, the elastic piece is a sheet-like structure; the elastic piece comprises a root fixedly connected to the fork body, and a free end away from the fork body; a width of the elastic piece is gradually reduced from the root to the free end; and the thickness of the elastic piece is gradually reduced from the root to the free end.

15. The cartridge core according to claim 9, wherein in the fork, a thickness of a thickest portion of the elastic piece is ⅓ to ½ of an average wall thickness of the fork body.

16. The cartridge core according to claim 15, wherein in the fork, the average wall thickness of the fork body ranges from 0.4 mm to 1 mm, and the thickness of the thickest portion of the elastic piece ranges from 0.15 mm to 0.5 mm.

17. The cartridge core according to claim 9, wherein in the fork, the elastic piece is a sheet-like structure; the elastic piece comprises a root fixedly connected to the fork body, and a free end away from the fork body; a width of the elastic piece is gradually reduced from the root to the free end; and the thickness of the elastic piece is gradually reduced from the root to the free end.

18. The cartridge core according to claim 17, wherein in the fork, the free end of the elastic piece has a thickness of D1, and the root of the elastic piece has a thickness of D2, the D1 ranging from 0.06 mm to 0.12 mm, and the D2 ranging from 0.12 mm to 0.18 mm; and a length from the root of the elastic piece to the free end of the elastic piece is L, the L ranging from 0.8 mm to 1.5 mm.

19. The cartridge core according to claim 17, wherein in the fork, the elastic piece comprises an upper surface and a lower surface, and the upper surface and the lower surface are opposite to each other; the upper surface and the lower surface are gradually adjacent from the root of the elastic piece to the free end of the elastic piece; both the upper surface and the lower surface are obliquely provided on the fork body; or the upper surface is obliquely provided on the fork body, and the lower surface is vertically provided on the fork body; or the upper surface is vertically provided on the fork body, and the lower surface is obliquely provided on the fork body.

20. The cartridge core according to claim 19, wherein in the fork, there is an included angle $\alpha$ between the lower surface and the fork body, $\alpha>90°$; a retainer ring is provided on the fork body between the elastic piece and the coupling portion; and a distance between the retainer ring and the upper surface of the elastic piece is H, the H ranging from 1.5 mm to 2.5 mm.

* * * * *